US007423189B2

(12) United States Patent
Chen

(10) Patent No.: US 7,423,189 B2
(45) Date of Patent: Sep. 9, 2008

(54) METHOD OF UTILIZING A CATALYTIC REACTION TO RECYCLE ORGANIC SCRAP

(76) Inventor: Andy H. C. Chen, 3F., No. 132, Singyun St., Neihu District, Taipei City 114 (TW)

( * ) Notice: Subject to any disclaimer, the term of this patent is extended or adjusted under 35 U.S.C. 154(b) by 247 days.

(21) Appl. No.: 11/369,830

(22) Filed: Mar. 8, 2006

(65) Prior Publication Data

US 2007/0213571 A1 Sep. 13, 2007

(51) Int. Cl.
*C10G 1/10* (2006.01)
*C07C 1/00* (2006.01)

(52) U.S. Cl. ..... 585/241; 585/240; 585/242; 585/820; 585/850; 201/2.5; 201/25

(58) Field of Classification Search ..... 585/240, 585/241, 242, 820, 850; 201/2.5, 25
See application file for complete search history.

(56) References Cited

U.S. PATENT DOCUMENTS 5,811,606 A * 9/1998 Yang ..... 585/241
6,133,491 A * 10/2000 Xing ..... 585/241
6,774,271 B2 * 8/2004 Jiang ..... 585/241

* cited by examiner

*Primary Examiner*—Glenn Caldarola
*Assistant Examiner*—Prem C. Singh
(74) *Attorney, Agent, or Firm*—Rosenberg, Klein & Lee

(57) ABSTRACT

The present invention discloses a method of utilizing a catalytic reaction to recycle organic scrap, wherein via a special cracking equipment, a special catalyst and a two-stage cracking process, the present invention not only can effectively convert organic scrap into regenerated oil but also can promote the yield and quality of the regenerated oil; further, the method of the present invention can overcome environmental problems and has the characteristics of high safety, high stability, and high economic efficiency.

8 Claims, 1 Drawing Sheet

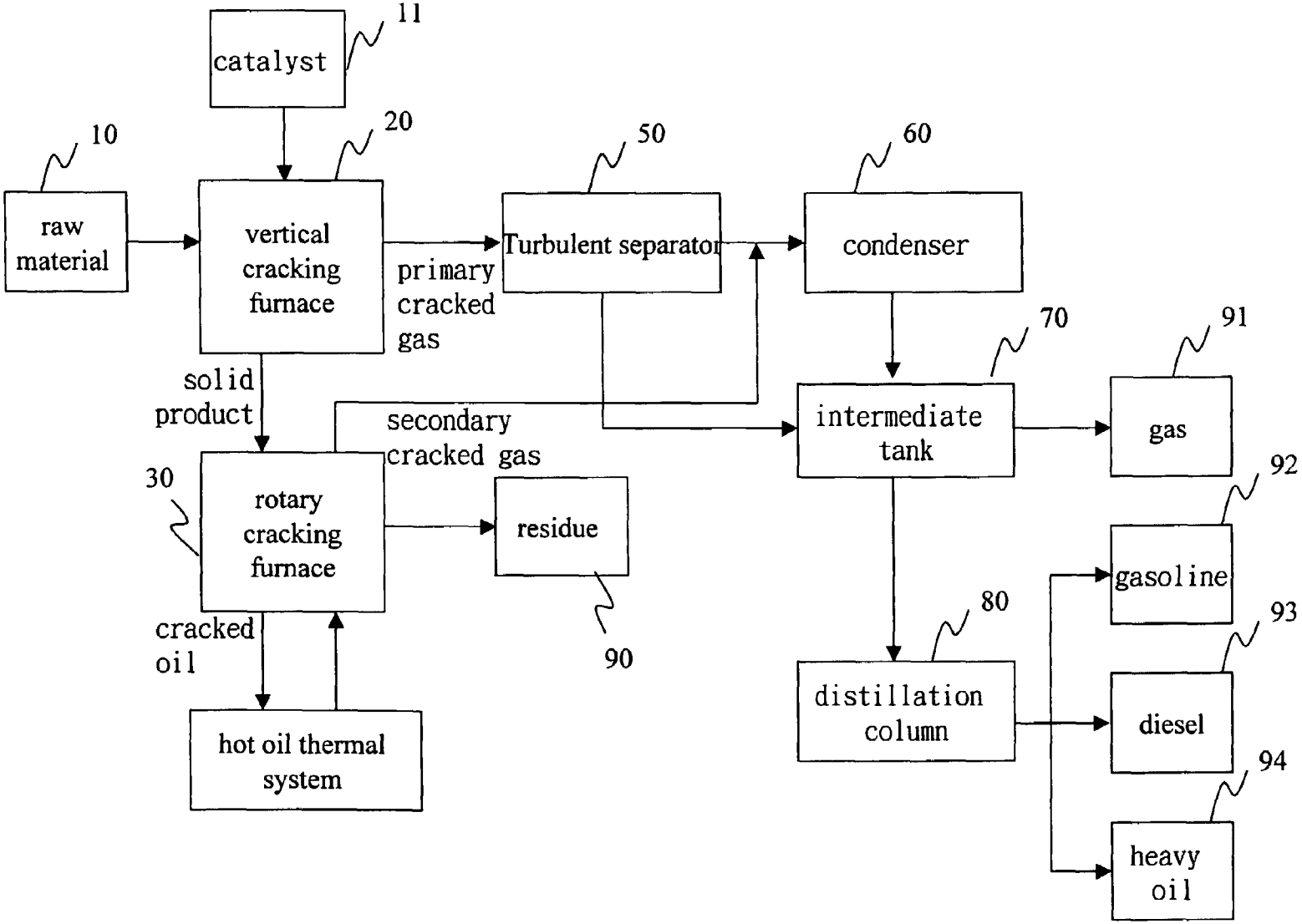
10
raw material
11
catalyst
20
vertical cracking furnace
primary cracked gas
solid product
50
Turbulent separator
60
condenser
secondary cracked gas
30
rotary cracking furnace
cracked oil
hot oil thermal system
residue
90
70
intermediate tank
80
distillation column
91
gas
92
gasoline
93
diesel
94
heavy oil

METHOD OF UTILIZING A CATALYTIC REACTION TO RECYCLE ORGANIC SCRAP

BACKGROUND OF THE INVENTION

1. Field of the Invention

The present invention relates to a method of recycling organic scrap, particularly to a method of utilizing a catalytic reaction to recycle organic scrap.

2. Description of the Related Art

Owing to massive energy consumption, energy resource is being exhausted gradually. Further, in 2005, the Kyoto Treaty to UNFCCC (the United Nations Framework Convention on Climate Change) entered into force, and the regulations of controlling carbon dioxide emission has come to work then. Now, many nations have regarded energy-regeneration as a high-priority target. Therefore, recycling scrap is no more only for environmental protection but is also for energy regeneration. Scrap is no more a useless, or even harmful waste but may be an economic-efficient resource.

The plastic is often used as the insulation materials of cables, current/potential transformers, and transformers include: thermoplastic PE (polyethylene), thermosetting Si-XLPE (silane cross-linked polyethylene), and thermosetting Epoxy resin. Part of it is often used filling grease (usually petroleum naphtha) to protect it from humidity and water. Those industrial scraps come from the abovementioned parts should be recycled; however, the recycling process not only should be environment-friendly but also should be able to produce high-quality regenerated energy, and clean metals with undamaged mechanical and electrical properties.

In the conventional treatments, current/potential transformers, transformers and cables, which contain thermosetting PE or thermosetting resin, and products, which contain composite material, are essentially buried or burned. The conventional treatments primarily adopt mechanically-processing methods to separate insulation materials from metals in a destructive way. Among those mechanically-processed scraps, the organic scraps of high plasticity and high moldability, such as PE and PVC scraps, are to be recycled; the contaminated scraps, such as grease- or paint-containing scraps, are not recycled but abandoned since the properties thereof will be influenced by contaminants; the metals recycled from the mechanically-processed metallic scraps will be contaminated by the insulation materials sticking to the metal surface during the recycling process. Owing to low flowability and inferior moldability, the thermosetting XLPE and Epoxy scraps are hard to recycle and will be buried or burned, which not only causes pollution but also disobeys the final objective of the sustainable development of UNFCCC.

At present, most of the commercialized technologies for recycling solid scrap adopt the thermal-cracking method, which cracks solid scrap into high-value-added heavy oil, light fuel oil, petroleum gas, and coke.

However, the conventional thermal-cracking method not only cannot process the scraps containing thermosetting plastic, paint, or grease but also has to heat the scraps to the temperature as high as more than 550~600° C. The thermal conductivity of organic scrap is very low, therefore, the heating time will be very long, and the processing capacity is hard to promote. Thus, the conventional thermal-cracking method is relatively uneconomical. Besides, the coke generated by the conventional thermal-cracking method contains a very high proportion of oil; thus, it should be processed once more to meet safety and environmental-protection requirements. The conventional thermal-cracking method adopts a one-stage horizontal cracking furnace; the utilization rate of the conventional cracking furnace and the yield rate of the regenerated oil still have much room to improve. Furthermore, owing to gaseous or solid blocking, fires or explosions often take place in the conventional horizontal cracking furnace. Therefore, the conventional horizontal cracking furnace also has serious safety problems to overcome.

SUMMARY OF THE INVENTION

The primary objective of the present invention is to provide a method of utilizing a catalytic reaction to recycle organic scrap to overcome the abovementioned problems, wherein the two-stage cracking process of the present invention not only can recycle thermosetting plastic-containing scrap and paint- or grease-containing scrap, but also can greatly promote the quality and the yield rate of regenerated oil, and the utilization rate of recycling equipments. Further, owing to the perfect cracking process of the present invention, the generated coke has a very low proportion of residual oil; thus, it can be further fabricated into useful products; for example, the coke generated by recycling rubber scrap can be further fabricated into carbon black or active carbon, the coke generated by recycling plastic scrap can be further fabricated into hollow bricks or aggregates; if the coke is otherwise buried directly, there is no environmental problem to scruple. Therefore, the present invention can look after both sides of environmental requirement, safety and economic efficiency.

To achieve the abovementioned objective, the present invention proposes a method of utilizing a catalytic reaction to recycle organic scrap, which comprises the following steps: firstly, placing organic scrap and a catalyst into a vertical cracking furnace to crack the organic scrap into a primary cracked gas and a solid product with the first cracked gas output from the top of the vertical cracking furnace and the solid product left on the bottom of the vertical cracking furnace, wherein the reaction temperature should be higher than about 220~230° C., but 350~380° C. is preferred, and the reaction pressure is slightly positive to the atmospheric pressure; next, feeding the solid product into a rotary cracking furnace to undertake a secondary cracking reaction and generate a secondary cracked gas, cracked oil, and residues, including coke and metals, wherein the reaction temperature is about 365~390° C. The primary cracked gas, the secondary cracked gas and the cracked oil can be further processed with separating procedures, such as filtration, condensation, and distillation, and converted into various regenerated oils.

The method of utilizing a catalytic reaction to recycle organic scrap of the present invention adopts a two-stage cracking process. The first-stage cracking reaction is to utilize a vertical cracking furnace to separate the reactant into a primary cracked gas and a solid product, so that the blocking problem will no more occur. The second-stage reaction is to utilize a rotary cracking furnace to crack the solid product generated by the first-stage reaction in order to increase the recycling efficiency of the cracking reaction. Furthermore, a mica-based or silica-based catalyst can also be used in the cracking reaction; such a catalyst comprises: 55~62% silica ($SiO_2$), 4~7% potassium oxide ($K_2O$), 0.5~1.5% sodium oxide (NaO), 2~2.5% ferric oxide ($Fe_2O_3$), 0.2~1% titanium oxide ($TiO_2$), 27~35% alumina ($Al_2O_3$), 0.2~1% magnesia (MgO), and 0.5~1.5% calcium oxide (CaO). Thereby, the present invention can achieve the efficacies of lowering cracking temperature, operating cost and equipment cost, as well as increasing safety, equipment utilization rate, yield rate and value-added of regenerated oil and economic efficiency.

To enable the objectives, characteristics, and efficacies of the present invention to be more easily understood, the embodiments of the present invention are to be described below in detail in cooperation with the drawings.

BRIEF DESCRIPTION OF THE DRAWINGS

The Figure is a flowchart schematically showing the method of utilizing a catalytic reaction to recycle organic scrap according to an embodiment of the present invention.

DETAILED DESCRIPTION OF THE INVENTION

Refer to the FIGURE, a flowchart of the method of utilizing a catalytic reaction to recycle organic scrap according to an embodiment of the present invention. In this embodiment, thermoplastic PE (polyethylene), thermosetting resin-containing current/potential transformers, thermosetting XLPE (cross-linked polyethylene), oil sludge, and waste tires are processed into high-quality regenerated oils. The process according to this embodiment will be described below in detail.

Firstly, the abovementioned organic scraps (i.e. PE, current/potential transformers, XLPE, oil sludge, and waste tires) are used as raw material 10. The raw material 10 together with a special catalyst 11 is fed into a vertical cracking furnace 20. Owing to the catalytic effect of the catalyst 11, the organic-scrap raw material 10 is massively and quickly cracked. In this stage, as the cracking furnace 20 is vertical, a primary cracked gas, which is generated in the cracking reaction, will rise to the top of the vertical furnace 20, and a solid product will be left on the bottom of the vertical furnace 20 by the gravity, and thus, the gaseous and solid products (the primary cracked gas and the solid product) will not block each other. Therefore, the internal pressure of the cracking furnace can be maintained just a little above the atmospheric pressure, and the safety can be promoted.

The embodiment of the present invention adopts a mica-based or silica-based catalyst 11, which comprises: 55~62% silica ($SiO_2$), 4~7% potassium oxide ($K_2O$), 0.5~1.5% sodium oxide (NaO), 2~2.5% ferric oxide ($Fe_2O_3$), 0.2~1% titanium oxide ($TiO_2$), 27~35% alumina ($Al_2O_3$), 0.2~1% magnesia (MgO), and 0.5~1.5% calcium oxide (CaO). For such a catalyst, a temperature as low as only 220~230° C. is enough to induce a cracking reaction; however, the catalyst will achieve the best performance at the temperature of 350~380° C.

After the cracking reaction has undertaken for a period of time, PE, current/potential transformers, XLPE, or oil sludge in the organic-scrap raw material 10 is cracked into the primary cracked gas and the solid product respectively with the gas percentage (by weight) of 95%, 88.1%, 20.7%, or 25.0%, and the solid percentage (by weight) of 5.0%, 11.9%,79.3%, or 75.0%.

At this time, as the solid product has been accumulated and agglomerated on the bottom of the vertical cracking furnace 20, full reaction is hard to achieve. In the embodiment of the present invention, a rotary cracking furnace 30 is further installed below the vertical cracking furnace 20, and the solid product can be directly fed into the rotary cracking furnace 30 via a slide gate to continue the cracking reaction. The rotary cracking furnace 30 can uniformly agitate the solid product to increase the contact area for the cracking reaction and accelerate the cracking reaction. Further, according to the properties of the organic scrap, the rotary cracking furnace 30 may be either an internal-rotation-type one or an external-rotation-type one. The reaction temperature of the rotary cracking furnace 30 ranges from 365 to 390° C.

In this stage, the reaction products are a secondary cracked gas and a cracked oil; the secondary cracked gas will rise to the top of the rotary cracking furnace 30 and be guided out therefrom, and flow through the condenser 60; the cracked oil will be guided through the oil pipes collecting into the intermediate tank 70, and then, the cracked oil collected will be further processed in the distillation system. In the embodiment of the present invention, for PE, current/potential transformers, XLPE, or oil sludge, which is used as the organic-scrap raw material 10, the proportions of the secondary cracked gas plus the cracked oil generated are respectively 3.0%, 1.6%, 0%, or 3.0% with respect to the weight of individual organic-scrap raw material 10, and the proportions of the solid residue 90 (including coke and metals) are respectively 2.0%, 10.3%, 79.3% or 72.0% with respect to the weight of individual organic-scrap raw material 10.

After those two stages of cracking reactions, the primary cracked gas, the secondary cracked gas, and the cracked oil will be processed with turbulent separators 50 and condensers 60 to undertake liquid-gas separation, and then the oil will be collected into intermediate tanks 70. The collected oil will be further processed in distillation columns 80 with different distillation conditions to generate various oil products, including a gas 91, a gasoline 92, a diesel 93, and a heavy oil 94. In the embodiment of the present invention, for PE, current/potential transformers, XLPE, or oil sludge, which is used as the organic-scrap raw material 10, the proportions of the gas 91 are respectively 15.0%, 17.8%, 9.2%, or 2.8% with respect to the weight of individual organic-scrap raw material 10, and the proportions of the gasoline 92 are respectively 16.6%, 9.3%, 1.2% or 8.8% with respect to the weight of individual organic-scrap raw material 10, and the proportions of the diesel 93 are respectively 24.9%, 21.7%, 2.3% or 13.9% with respect to the weight of individual organic-scrap raw material 10, and the proportions of the heavy oil 94 are respectively 41.5%, 40.9%, 8.0%, or 2.5% with respect to the weight of individual organic-scrap raw material 10.

According to the analysis based on the distillation method, the cracked oil product generated via the method of this embodiment contains 30% gasoline, and 97% of the gasoline meets the CPC (Chinese Petroleum Corporation) premium gasoline 95 standard. Thus, the cracking temperature used by the embodiment of the present invention can really insure that the organic scrap can be fully cracked into the regenerated oil.

A small-scale cracking equipment is used to implement the embodiment of the present invention, and the amount of the cracked gas generated by the catalytic cracking reaction is small also; the cracked gas is used as the main fuel source of the catalytic cracking process, and the waste gas generated by gas burners of the cracking furnaces is limited, which is verified by the tests illustrated below. Table. 1 shows the concentrations of sulfur oxide, nitrogen oxide, and particulates in the waste gas exhausted by the process of this embodiment. Table 2 shows the analysis of the components of the heavy metals of the solid residue generated by the process of this embodiment.

TABLE 1

| Test item | Test result (XLPE/Transformer/Oil sludge/Waste tire) | Emission standard | Test method |
|---|---|---|---|
| Total sulfur oxide (SO*x*) (ppm) | 43/76/71/32 | 300 | NDIR (A413.72C) |
| Total nitrogen | 77/40/34/5 | 250 | NDIR |

TABLE 1-continued

| Test item | Test result (XLPE/Transformer/Oil sludge/Waste tire) | Emission standard | Test method |
|---|---|---|---|
| oxide (NOx) (Ppm) | | | (A411.72C) |
| Paticulates ($mg/m^3$) | 25/22/13.7/21 | 70 | Weigh-capture method (A101.72C) |

TABLE 2

| Analysis Item Unit: mg/L | Test result (XLPE/ Transformer/Oil sludge) | Taiwan Published Standard | Test method |
|---|---|---|---|
| Total Arsenic | 0.01/ND/ND | 5.0 | NIEA-R318.10C |
| Total Mercury | ND/ND/0.2 | 0.2 | NIEA-R314.11C |
| Total Cadmium | 0.03/ND/0.033 | 1.0 | NIEA-R306.11C |
| Total Chromium | ND/ND/0.07 | 5.0 | NIEA-R306.11C |
| Hexavalent Chromium | ND/ND/ND | 2.5 | NIEA-R309.12C |
| Total Copper | 0.41/ND/0.02 | 15.0 | NIEA-R306.11C |
| Total Lead | 21.2/ND/ND | 5.0 | NIEA-R306.11C |
| Total Selenium | ND/ND/ND | 1.0 | NIEA-R300.10C |

In summary, the present invention provides a method of utilizing a catalytic reaction to recycle organic scrap, wherein via the special cracking equipment, the special catalyst and the two-stage cracking process disclosed in the present invention, not only the yield rate of the regenerated oil recycled from waste thermoplastic plastic, waste rubber, waste oil sludge, etc. can be increased, but also the quality of the regenerated oil and the utilization rate of the cracking equipments are greatly promoted. Besides, the low cracking temperature used by the present invention not only can save energy, processing cost, and equipment cost but also can promote safety. Furthermore, the present invention is free from secondary pollution and meets environmental requirements.

What the present invention can process includes: plastic, rubber, the mixture of plastic and rubber, and the scraps other technologies cannot process, such as oil bottles, oil tanks, composite materials, grease-containing cables, the mixture of automobile parts, and thermosetting resin-containing elements and parts of high-voltage systems (including: transformers, potential transformers, current transformers, and high-voltage cables). Furthermore, the present invention can also be used to process oil shale, oil sand, oil sludge, optical fiber, etc., to exploit new energy source.

Those embodiments described above are to clarify the present invention; however, it is not intended to limit the scope of the present invention, and any equivalent variation and modification according to the spirit of the present invention is to be also included within the scope of the present invention. The claims of the present invention are to be stated below.

What is claimed is:

1. A method of utilizing a catalytic reaction to recycle organic scrap, comprising the following steps:

placing an organic scrap and a catalyst into a vertical cracking furnace to crack said organic scrap into a primary cracked gas and a solid product at a reaction temperature higher than 220° C., said catalyst including 55~62% silica ($SiO_2$), 4~7% potassium oxide ($K_2O$), 0.5~35% sodium oxide (NaO), 2~2.5% ferric oxide ($Fe_2O_3$), 0.2~1% titanium oxide ($TiO_2$), 27~35% alumina ($Al_2O_3$), 0.2~1% magnesia (MgO), and 0.5~1.5% calcium oxide (CaO); and collecting said primary cracked gas from the top of said vertical cracking furnace, and feeding said solid product into a rotary cracking furnace, which is installed below said vertical cracking furnace, to crack said solid product into a secondary cracked gas and a cracked oil at a reaction temperature raging from 365 to 390° C.

2. The method of utilizing a catalytic reaction to recycle organic scrap according to claim 1, wherein according to the properties of said organic scrap, said rotary cracking furnace may be either an internal-rotation-type one or an external-rotation-type one.

3. The method of utilizing a catalytic reaction to recycle organic scrap according to claim 1, wherein the reaction temperature of said vertical cracking furnace ranges from 350 to 380° C.

4. The method of utilizing a catalytic reaction to recycle organic scrap according to claim 1, wherein said primary cracked gas and said solid product are separated via the upward floating of said primary cracked gas and the gravity-induced downward falling of said solid product.

5. The method of utilizing a catalytic reaction to recycle organic scrap according to claim 1, wherein said rotary cracking furnace tumbles said solid product uniformly to increase the contact area for the cracking reaction.

6. The method of utilizing a catalytic reaction to recycle organic scrap according to claim 1, wherein subsequent to the step of cracking said organic scrap into a primary cracked gas and a solid product, separating said primary cracked gas into at least one regenerated oil.

7. The method of utilizing a catalytic reaction to recycle organic scrap according to claim 1, wherein subsequent to the step of cracking said solid product into a secondary cracked gas and a cracked oil, separating said secondary cracked gas into at least one regenerated oil.

8. The method of utilizing a catalytic reaction to recycle organic scrap according to claim 6, said cracked oil is further processed with a separating procedure, said separating procedure including one of filtration, condensation and distillation, for conversion into various regenerated oils.

* * * * *